United States Patent [19]

Jones et al.

[11] Patent Number: 4,483,787

[45] Date of Patent: Nov. 20, 1984

[54] CONCENTRATED AQUEOUS DETERGENT COMPOSITIONS

[75] Inventors: Keith A. Jones, Fairfield; John M. Weeman, Cincinnati, both of Ohio

[73] Assignee: The Procter & Gamble Company, Cincinnati, Ohio

[21] Appl. No.: 566,366

[22] Filed: Dec. 28, 1983

[51] Int. Cl.[3] ..... C11D 1/12

[52] U.S. Cl. ..... 252/551; 252/532; 252/174.17; 252/DIG. 14

[58] Field of Search ..... 252/174.17, 551, 532, 252/DIG. 14

[56] References Cited

U.S. PATENT DOCUMENTS

| | | | |
|---|---|---|---|
| 4,396,520 | 8/1983 | Payne et al. | 252/89.1 |
| 4,446,042 | 5/1984 | Leslie | 252/102 |

*Primary Examiner*—Paul Lieberman
*Assistant Examiner*—Hoa Van Le
*Attorney, Agent, or Firm*—Robert B. Aylor; Richard C. Witte; Thomas H. O'Flaherty

[57] ABSTRACT

Concentrated aqueous liquid detergent compositions comprising more than about 35% alkylpolyethoxylate sulfate detergent surfactant and an alkyloligoglycoside detergent surfactant.

15 Claims, No Drawings

CONCENTRATED AQUEOUS DETERGENT COMPOSITIONS

FIELD OF THE INVENTION

This invention relates to concentrated aqueous liquid detergent compositions which can be readily diluted to form a wash liquor.

DESCRIPTION OF THE PRIOR ART

Alkylpolyglycosides which are surfactants have been disclosed in U.S. Pat. Nos. 3,598,865; 3,721,633; and 3,772,269. These patents also disclose processes for making alkylpolyglycoside surfactants and built liquid detergent compositions containing these surfactants. U.S. Pat. Nos. 3,721,633 and 3,547,828 suggest that alkylpolyglycosides may have an advantage in formulating liquid detergent compositions. U.S. Pat. No. 3,219,656 discloses alkylmonoglucosides and suggests their utility as foam stabilizers for other surfactants. Various polyglycoside surfactant structures and processes for making them are disclosed in U.S. Pat. Nos. 2,974,134; 3,640,998; 3,839,318; 3,314,936; 3,346,558; 4,011,318; and 4,223,129. All of the above patents are incorporated herein by reference.

It is known that concentrated alkyl ether sulfate detergent surfactant formulas do not dilute readily as disclosed in U.S. Pat. No. 3,893,955-Hewitt et al (July 8, 1975). This patent, which is incorporated herein by reference, teaches the use of low molecular polycarboxylic acids to solve the problem.

SUMMARY OF THE INVENTION

This invention relates to the discovery that certain specific alkylpolysaccharide detergent surfactants when incorporated into concentrated aqueous liquid detergent compositions containing alkyethersulfate detergent surfactants allow the rapid formation of dilute wash liquors. Specifically this invention relates to concentrated aqueous liquid detergent compositions comprising (1) from about 35% to about 75% of detergent surfactant having the formula $RO(R^1O)_ySO_3M$ wherein R is an alkyl group containing from about 8 to about 20 carbon atoms, preferably from about 10 to about 16 carbon atoms, $R^1$ is ethylene or propylene, y is a number from about 1 to about 15, and M is a compatible cationic group, preferably one selected from the group consisting of, sodium, potassium, ammonium, substituted ammonium, e.g., mono-, di-, or triethanolammonium, magnesium and mixtures thereof;

(2) from about 1% to about 35% of a detergent surfactant having the formula $R^2O(R^3O)_Y(Z)_x$ where Z is a moiety derived from a reducing saccharide containing from 5 to 6 carbon atoms; x is a number from about 1½ to about 8 as an average; $R^2$ is an alkyl, alkylphenyl, hydroxy alkylphenyl, or hydroxyalkyl hydrophobic group containing from about 6 to about 30 carbon atoms; each $R^3$ is an ethoxy, propoxy or glyceryl group; and Y is from 0 to about 10; the ratio of carbons in the hydrophobic group to the number of saccharide moieties being from about 1:1 to about 30:1; and (3) the balance being selected from the group consisting of water, lower molecular weight alcohols containing from 1 to about 4 carbon atoms, and mixtures thereof.

DESCRIPTION OF THE PREFERRED EMBODIMENTS

The Alkylether Sulfate Detergent Surfactant

The alkylether sulfate detergent surfactants are those in which the alkyl group contains from about 8 to about 20 carbon atoms, preferably from about 10 to about 16 carbon atoms, and wherein the polyether chain contains from about 1 to about 15 ethoxy or propoxy moieties, preferably from about 1 to about 3 ethoxy moieties. These anionic detergent surfactants are particularly desirable for formulating heavy duty liquid laundry detergent compositions, particularly compositions which are either unbuilt or lightly built with insufficient detergency builders to control, e.g., the calcium ions in the water.

Preferred alkylether sulfate detergent surfactants include those having alkyl chains containing from 14 to 15 carbon atoms, which contain either about 1 or about 2 ethylene oxide moieties per molecule on the average, and which are neutralized to form either the sodium, potassium, monoethanolammonium, diethanolammonium, triethanolammonium and/or magnesium salts. Other desirable alkyl ether sulfate detergent surfactants include those derived from coconut fatty alcohols, tallow fatty alcohols, and mixtures thereof, having the 1, 2 or 3 ethylene oxide groups on the average and the said preferred cations.

These alkyl ether detergent surfactants, when incorporated in an aqueous detergent composition at levels above about 35%, preferably above about 45%, do not readily dilute when a portion of the concentrated detergent composition is added to water. It is believed that this due to the formation of a slowly soluble phase which inhibits further dilution.

The Alkylpolysaccharide Detergent Surfactant

The alkylpolysaccharides of this invention are those having a hydrophobic group containing from about 6 to about 30 carbon atoms, preferably from about 8 to about 18 carbon atoms, most preferably from about 12 to about 16 carbon atoms, and a polysaccharide (5–6 carbon atoms in each reducing saccharide unit, e.g., galactose, glucose, glucosyl and/or galactosyl) hydrophilic group containing from about 1.5 to about 8, preferably from about 1.6 to about 3 saccharide units on the average. For example, galactosyl moieties and/or glucosyl moieties can be used and the hydrophobic group can be attached at the 1-, 2-, 3-, or 4-positions, thus giving, e.g., either a glucose or galactose or glucoside or galactoside. The intersaccharide bonds can be, e.g., between the one position of the additional saccharide units and the 2-, 3-, 4-, or 6-position on the preceeding saccharide units.

Optionally there can be a polyalkoxide chain joining the hydrophobic moiety and the poly(e.g., glucose, galactose, glucosyl, and/or galactosyl) saccharide moiety. The preferred alkoxide moiety is ethoxide. Typical hydrophobic groups include alkyl groups, either saturated or unsaturated, branched or unbranched containing from about 6 to about 30, preferably from about 8 to about 18 carbon atoms. Preferably, the alkyl group is a straight chain saturated alkyl group. The alkyl group can contain up to 3 hydroxy groups and/or the polyalkoxide chain can contain up to about 10, preferably less than 5, most preferably 0, alkoxide moieties. Suitable alkylpolysaccharides are octyl, decyl, dodecyl, tridecyl, tetradecyl, pentadecyl, hexadecyl, heptadecyl and octadecyl, di-, tri-, tetra-, penta-, and hexaglucosides, galactosides, lactosides, glucoses, fructosides, fructoses, and/or galactoses. Suitable mixtures include coconut alkyl-mono-, di-, tri-, tetra-, and pentaglucosides and tallow alkyl tri-, tetra-, penta-, and hexaglucosides.

The preferred alkylpolyglycosides have the formula $$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and mixtures thereof containing from about 9 to about 18, preferably from about 12 to about 14 carbon atoms, n is 2 or 3, preferably 2, t is from 0 to about 10, preferably 0, and x is from about 1½ to about 8, preferably from about 1½ to about 4, most preferably from about 1.6 to about 2.7. To prepare these compounds the alcohol or alkylpolyethoxy alcohol is formed first and then reacted with the, e.g., glucose to form the alkylglucoside (attachment at the 1-position). The additional glucose monomers are attached through their 1-position to the original glucose units' 2-, 3-, 4-, or 6-positions, preferably predominantly the 2 position.

For solubilizing inorganic salts, the ratio of saccharide units to alkyl chain carbons is from about 1:1 to about 1:20, preferably from about 1:2 to about 1:4.

Preferably the content of alkylmonosaccharide, e.g., alkylmonoglucoside is low, preferably less than about 10%, since the alkylmonoglucoside is relatively less effective and acts as an impurity. Also, the alkylmonoglucosides are relatively less soluble in water.

As used hereinafter, "alkylpolysaccharide surfactant" is intended to represent both the preferred alkylpolyglycoside surfactants derived from glucose and the other alkylpolysaccharides, e.g., alkylpoly(glucose, galactose, glucosyl, and/or galactosyl) surfactants.

Known analytical techniques can be used to determine the structures of the alkylpolysaccharide surfactants herein; for example, to determine the glycosidic chain length, the amount of butyl glucoside, the free fatty alcohol content, and the level of unreacted polysaccharide. More specifically, gas for liquid chromatography can be used to determine the unreacted alcohol content and the unreacted polysaccharide content respectively. Proton nmr can be used to determine the average glycosidic chain length. The point of attachment of the hydrophilic portion of the molecule to the hydrophobic portion of the molecule can be determined by $^{13}C$ nmr.

The alkylpolysaccharide surfactants are complex mixtures. Their components vary depending upon the nature of the starting materials and the reaction by which they are prepared. Analytical standards which are useful in calibrating instruments for analyzing the components of a particular alkylpolysaccharide surfactant can be obtained from Calbiochem Behring Co. LaJolla, Calif. These standards include those for octylglucoside (Calbiochem #494559), decylglucoside (Calbiochem #252715), and dodecylmaltoside (Calbiochem #3243555).

The amount of alkylpolysaccharide is preferably from about ½% to about 25%, most preferably from about 5% to about 15%.

Other Ingredients

The detergent compositions herein can also contain from 0% to about 60%, preferably from about 5% to about 50% of a detergency builder, preferably an effective chelating builder that controls calcium and/or magnesium ions. Suitable builders are disclosed in U.S. Pat. No. 4,303,556, incorporated herein by reference. Preferred levels of builders are from about 10% to about 40%, more preferably from about 10% to about 30%.

The compositions and processes of this invention can utilize other compatible ingredients, including other detergent surfactants, in addition to the essential detergent surfactant mixture. In detergent compositions the compositions can contain any of the well known ingredients including minor amounts of other surfactants, detergency builders, soil suspending agents, brighteners, abrasives, dyes, fabric conditioning agents, hair conditioning agents, hydrotropes, solvents, fillers, etc. Suitable ingredients are disclosed in U.S. Pat. Nos. 4,166,039, Wise; 4,157,978-Llenado; 4,056,481-Tate; 4,049,586-Collier; 4,035,257-Cherney; 4,019,998-Benson et al; 4,000,080-Bartolotta et al; and 3,983,078-Collins, incorporated herein by reference. Listings of suitable additional ingredients, including low levels of other surfactants can be found in U.S. Pat. Nos. 4,089,945; 3,987,161; and 3,962,418, incorporated herein by reference.

Particularly preferred additives are conventional nonionic detergent surfactants as set forth in the copending application of Ramon A. Llenado, Ser. No. 506,936, filed July 13, 1983, said application being incorporated herein by reference. Other preferred additives are conventional soil suspending and antiredeposition aids.

All percentages, parts, and ratios used herein are by weight unless otherwise specified.

The following examples illustrate the compositions of the present invention.

EXAMPLE I

A concentrated liquid detergent composition was prepared containing 49.1% ammonium $C_{12-14}$ alkylpolyethoxylate (3), sulfate, 24.6% $C_{12-13}$ alkyloligoglycoside (2.5), 16.2% ethanol, and the balance water. This composition dissolved readily, whereas a similar composition without the alkyloligoglycoside did not dissolve readily upon dillution at 115° F. An additional composition containing 69.5% of the ammonium $C_{14-15}$ alkylpolyethoxylate (3) sulfate, and 16.2% ethanol, the balance water, formed a thick, nonfluid gel upon dilution at 115° F. Use of the alkyloligoglycoside allows the preparation of more concentrated detergent compositions containing greater percentages of detergent surfactant which dissolve readily.

EXAMPLE II

Light Duty Liquid

| | percent |
|---|---|
| Sodium coconut alkyl sulfate | 10.4 |
| Sodium coconut alkylpolyethoxylate(1)sulfate | 47.6 |
| Sodium xylene sulfonate | 1.0 |
| Ethanol | 10.0 |
| Coconut alkyldimethylamine oxide | 2.8 |
| Coconut alkyloligoglycoside (3.0) | 15.0 |
| Water | balance |

EXAMPLE III

Light Duty Liquid

| | percent |
|---|---|
| Magnesium coconut alkyl sulfate | 10. |
| Magnesium coconut alkylpolyethoxylate(3) sulfate | 25.8 |
| Ammonium coconut alkylpolyethoxylate(3)sulfate | 14.0 |
| Sodium xylene sulfonate | 3.0 |
| Ethanol | 15.0 |
| Monoethanolamine (MEA) | 2.0 |
| Coconut alkyloligoglycoside (1.5) | 10.0 |
| Tallow alkylpolyethoxylate (18) | 6.0 |
| Water | balance |

EXAMPLE IV

Light Duty Liquid

| | percent |
|---|---|
| Sodium coconut alkylpolyethoxylate(6)sulfate | 65.0 |
| Coconut alkyldimethylamine oxide | 3.0 |
| Ethanol | 10.0 |
| Coconut alkyloligoglycoside (1.2) | 20.0 |
| Water | balance |

EXAMPLE V

HEAVY DUTY LIQUID

| | percent |
|---|---|
| Sodium $C_{14-16}$ alkylethoxylate(1)sulfate | 35.0 |
| Sodium $C_{11-12}$ alkylbenzene sulfonate | 20.0 |
| Sodium nitrilotriacetate | 10.0 |
| Ethanol | 5.0 |
| $C_{12-13}$ alkyloligoglycoside (1.6) | 25.0 |
| Water | balance |

EXAMPLE VI

| | percent |
|---|---|
| Sodium $C_{14-16}$ alkylpolyethoxylate(6)sulfate | 40.0 |
| $C_{14-16}$ alkyloligoglycoside (2.1) | 15.0 |
| Sodium pyrophosphate | 35.0 |
| Ethanol | 5.0 |
| Water | balance |

What is claimed is:

1. A concentrated aqueous liquid detergent composition comprising:

(1) from about 35% to about 75% of detergent surfactant having the formula $RO(R^1O)_ySO_3M$ wherein R is an alkyl group containing from about 8 to about 20 carbon atoms, $R^1$ is ethylene or propylene, y is a number from about 1 to about 15, and M is a compatible cationic group;

(2) from about 1% to about 35% of a detergent surfactant having the formula $R^2O(R^3O)_y(Z)_x$ where Z is a moiety derived from a reducing saccharide containing from 5 to 6 carbon atoms; x is a number from about $1\frac{1}{2}$ to about 8 as an average; R is an alkyl, alkylphenyl, hydroxy alkylphenyl, or hydroxyalkyl hydrophobic group containing from about 6 to about 30 carbon atoms; each $R^1$ is an ethoxy, propoxy or glyceryl group; and Y is from 0 to about 10; the ratio of carbons in the hydrophobic group to the number of saccharide moieties being from about 1:1 to about 30:1; and (3) the balance being selected from the group consisting of water, lower molecular weight alcohols containing from 1 to about 4 carbon atoms, and mixtures thereof.

2. The composition of claim 1 which contains more than about 45% of (1) and wherein R contains from about 10 to about 16 carbon atoms; Y is from about 1 to about 3; $R^1$ is ethylene; $R^2$ is an alkyl group containing from about 12 to about 14 carbon atoms; Y=0; X is from about $1\frac{1}{2}$ to about 4; and Z is derived from a reducing saccharide containing 6 carbon atoms.

3. The composition of claim 2 containing less than 60% detergency builder.

4. The composition of claim 3 containing from about 5 to about 50% detergency builder.

5. The composition of claim 2 wherein M is selected from the group consisting of sodium, potassium, ammonium, substituted ammonium, magnesium and mixtures thereof.

6. The composition of claim 5 wherein M is at least partly magnesium.

7. The composition of claim 2 wherein R contains from about 14 to 15 carbon atoms, Y is from about 1 to about 2 and X is from about 1.6 to about 3.

8. The composition of claim 7 wherein X is from about 1.6 to about 2.7.

9. The composition of claim 2 wherein X is from about 1.6 to about 2.7.

10. The composition of claim 1 containing less than 60% detergency builder.

11. The composition of claim 10 containing from about 5 to about 50% detergency builder.

12. The composition of claim 1 wherein M is selected from the group consisting of sodium, potassium, ammonium, substituted ammonium, magnesium and mixtures thereof.

13. The composition of claim 12 wherein M is at least partly magnesium.

14. The composition of claim 1 wherein R contains from about 14 to 15 carbon atoms, Y is from about 1 to about 2 and X is from about 1.6 to about 3.

15. The composition of claim 14 wherein X is from about 1.6 to about 2.7.

* * * * *